United States Patent [19]

Duerr

[11] 4,382,557

[45] May 10, 1983

[54] METHOD AND APPARATUS FOR DE-AERATING VISCOUS MIXING STOCK

[75] Inventor: Herbert Duerr, Viernheim, Fed. Rep. of Germany

[73] Assignee: Draiswerke GmbH, Mannheim, Fed. Rep. of Germany

[21] Appl. No.: 150,221

[22] Filed: May 12, 1980

[30] Foreign Application Priority Data

May 26, 1979 [DE] Fed. Rep. of Germany ..... 2921408

[51] Int. Cl.[3] ..... B02C 19/00

[52] U.S. Cl. ..... 241/1; 241/29; 241/46.11; 241/58; 241/172

[58] Field of Search ..... 241/57, 58, 30, 152 A, 241/152 R, 101 R, 1, 29, 46.11, 46.06, 46.15, 46.17, 172, 173; 366/348

[56] References Cited

U.S. PATENT DOCUMENTS

| | | | |
|---|---|---|---|
| 2,695,755 | 11/1954 | Denovan et al. | 241/57 X |
| 3,311,310 | 3/1967 | Engels et al. . | |
| 4,129,261 | 12/1978 | Engels et al. | 241/46.11 |
| 4,273,295 | 6/1981 | Pöllmann | 241/46.11 |

OTHER PUBLICATIONS

Engels, U., "Improvement of the Efficiency of Wet Operating Agitating Mills through Full-Volume Utilization and Avoidance of Air Inclusions", *Farse und Lack,* vol. 10, 1969.

*Primary Examiner*—Mark Rosenbaum
*Assistant Examiner*—Timothy V. Eley
*Attorney, Agent, or Firm*—Browdy and Neimark

[57] ABSTRACT

A de-aerating agitating mill, especially for paints, pigments and the like in which the mixing chamber is closed off from a discharge chamber which may be subjected to reduced pressure. The closure is effected by a separator device consisting of a central disk which is attached to the stirrer or agitator shaft and rotates in a hole within a stationary part of the casing. A narrow, annular gap between the periphery of the disk and the rim of the hole acts as an outlet channel through which the ground or mixed stock is extruded. The shear stresses exerted on the stock rupture the material and burst any air bubbles which are then removed by the vacuum.

12 Claims, 3 Drawing Figures

METHOD AND APPARATUS FOR DE-AERATING VISCOUS MIXING STOCK

FIELD OF THE INVENTION

The invention relates to an agitating mill having a cylindrical grinding/mixing container to be filled at least partially with grinding/mixing medium. A rotatable mixer element including a rotating shaft with radial extensions is disposed within the container.

BACKGROUND AND PRIOR ART

De-aeration of viscous grinding/mixing stock and, in particular of pasty or highly viscous stock, such as paints, is exceptionally difficult. A journal article by Engels entitled "Improvement of the efficiency of wet operating agitating mills through full-volume utilization and avoidance of air inclusions" published in the periodical journal "FARBE UND LACK" Vol. 10, 1969, describes the transfer of ground stock from a closed agitating mill into a collecting container. The agitating mill has a separator device consisting of a cylindrical sieve which holds back the medium present in the grinding chamber of the agitating mill. A storage container preceding the mill and a collection container behind the agitating mill are both subjected to a vacuum. The grinding chamber of the mill can also be subjected to a vacuum. This well-known configuration is inoperable, because the grinding stock tends to foam under the vacuum in the grinding chamber; the grinding medium also floats up and clogs the vacuum line. On the other hand, if vacuum is supplied only within the collection container, only a very small portion of the air is removed from the ground stock.

It is also known to add a dispersing and homogenizing aggregate to a heatable mixing tank and to provide successive vacuum de-aeration in a cone-shaped container in the form of a cone standing on its point, into whose upper end enters a pipe from the mixing tank. The viscous material supplied by this pipe line is deposited on a rapidly revolving disk, which throws off the relatively finely divided material while the container is subjected to a vacuum. A discharge pump is attached to the lower end of the container. This known embodiment works satisfactorily, but represents a considerable additional equipment expense.

It is further known to process pasty materials in a rolling mill, specifically in single or triple rolling mills in which the air is literally squeezed out of the material between the rollers.

SUMMARY OF THE INVENTION

It is the object of the present invention to provide a method and apparatus for simple de-aeration of viscous grinding or mixing stock. This object is attained by a method and apparatus according to the invention in which the ground or mixed material is forced from the grinding chamber while being subjected to shear stresses and while being exposed to sub-atmospheric pressure (vacuum). The simultaneous application of a reduced pressure and high shear stresses causes the stock to be ruptured to a high degree resulting in very good de-aeration. This effect is further enhanced if the stock is simultaneously expanded, and/or spread out into a thin film or layer. An agitating mill for implementing the method according to the invention is so constructed that the vacuum substantially does not enter the mixing chamber of the agitating mill, thereby avoiding the disadvantages which result from applying a vacuum directly to the agitating mill as done in the prior art. Yet the degree of de-aeration which is achieved exceeds that which could be achieved by use of a rolling mill and the form of the material obtained is what one would obtain from an agitating mill. All the capital expense of a rolling mill or of a separate vacuum de-aeration unit, as well as the corresponding energy expenditures, are entirely eliminated by the method and apparatus according to the invention.

In a favorable and preferred feature of the invention, the mixed stock is sheared and expanded simultaneously. In another advantageous feature of the invention, the agitating mill includes a narrow passage leading from the grinding chamber to the evacuated delivery chamber.

Still further advantages and distinguishing features of the invention will become evident from the following description of an exemplary embodiment which relates to the drawing.

Figure 1:
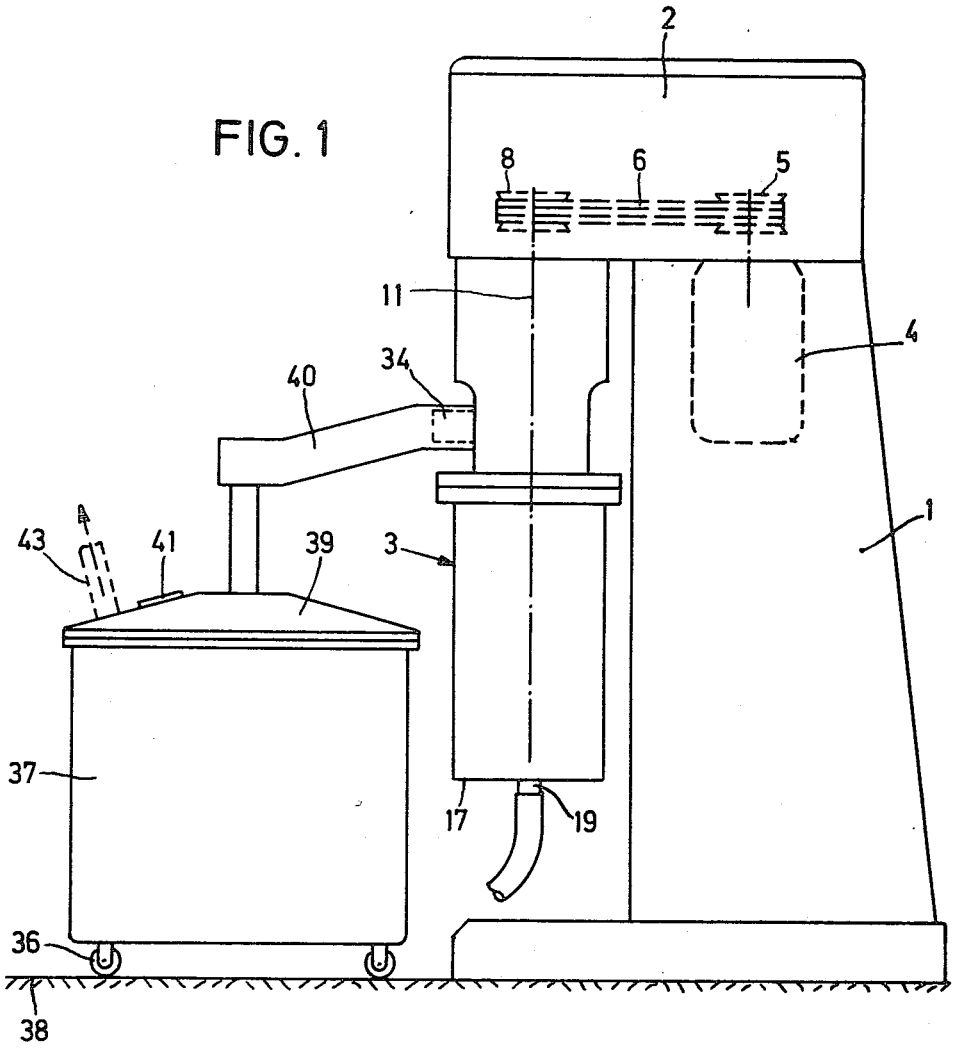
FIG. 1 is a schematic functional view of an agitating mill according to the invention including a collection container.

The agitating mill shown in the drawing includes, in customary manner, a base 1 to whose upper part is attached a projecting carrier arm 2. A cylindrical grinding or mixing chamber 3 is attached to the carrier arm 2. An electrical motor 4, located in the base 1, and provided with a V-belt pulley 5, provides rotary power to an agitator 7 via a V-belt 6 and a pulley 8 which is fixedly attached to the agitator 7.

The grinding or mixing container 3 has a cooling jacket 9 defined by a cylindrical inner wall 10 and a cylindrical outer wall 12 both concentric with the central longitudinal axis 11 of the grinding or mixing chamber 3. The inner wall 10 and outer wall 12 are joined to one another at the top and bottom by closure rings 13, 14. The cooling jacket 9 receives cooling water via a connection 15 while a cooling water discharge 16 is connected at the top. The container 3 is closed at the lower end by a bottom plate 17 attached, for example, by means of screws 18 to the closure ring 13 at the lower end of the cooling jacket. A stock supply line 19 is attached to the bottom plate 19, permitting grinding or mixing stock to be pumped from below into the grinding chamber 20 of the container 3.

The agitator 7 is oriented along the central longitudinal axis 11 and consists of a shaft 21 from which extend radial disks 22 that are supported nonrotatably relative to the shaft 21. Spacers 23 are located between neighboring disks 22 and several stirring rods 24 are attached to the outer circumference of each of the disks 22.

Complementary counter rods 25 are attached to the cylindrical inner wall 10 of the container 3 and extend into the grinding chamber 20. The rods 25 are so oriented as to always lie between two axially neighboring stirring rods 24. The detailed construction of the agitator 7 as a hollow, coolable agitator and the design of the counter rods 25 may be as represented and described in detail in U.S. Pat. No. 4,129,261.

The mixing chamber 20 is covered at the top by a separator 26 consisting of an annular disk 28 nonrotatably coupled to the agitator shaft 21 by means of a spring spline connector 27 and a concentric fixed counter ring 29. The counter ring 29 is attached to the upper end of the cooling jacket 9 by means of screws 30. The counter ring 29 also serves as a flange to which a cap 31 is secured by screws 32. The cap 31 encloses a discharge chamber 33, from which extends a discharge pipe 34. The agitator shaft 21 projects through the discharge chamber 33 and is carried through the cover cap 31 in a packed sleeve 35 (not shown in detail) in leaktight manner. The connection between the cover cap 31 and the container 3 is also made gas-tight and fluid-tight.

A movable collection container 37 equipped with rollers 36 is located near the agitating mill and is made gas-tight and fluid-tight by a removable lid 39. The discharge pipe 34 is connected to the container 37 via a transfer line 40 that leads into the lid 39 which may include a sight glass 41.

A vacuum may be applied to the discharge chamber 33 via a vacuum line 42. Alternatively, or additionally, a vacuum line 43 can be attached to, for example, the lid 39. Due to the interconnection of the discharge chamber 33 and the collection container 37 via the transfer line 40, any vacuum present in the discharge chamber 33 propagates to the collection container 37 or vice versa.

Figure 2:
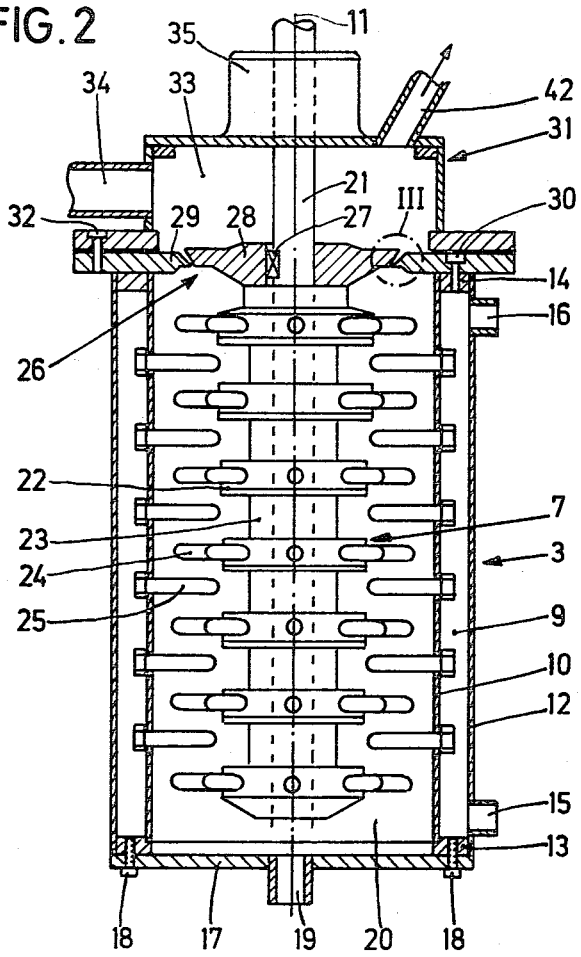
FIG. 2 illustrates the agitating mill of FIG. 1 in longitudinal cross section.
Figure 3:
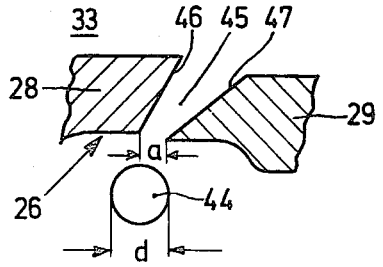
FIG. 3 is an enlarged partial section of FIG. 2.

The grinding or mixing chamber 20 is usually filled to 50%–70% of its free volume with auxiliary grinding elements 44, of which only one is represented in the enlarged partial section of FIG. 3. The grinding elements 44 are retained in the grinding chamber 20 by the separator device 26, due to the fact that the width "a" of the separator slit 45 between the annular disk 28 rotating with the agitator shaft 21 and the counter ring 29 fixedly attached to the grinding container 3, at its narrowest point (the portion facing the grinding chamber 20) is smaller than the diameter 'd' of the smallest grinding element 44 located in the grinding container 3. Hence no grinding elements 44 can enter the discharge chamber 33 through the separator slit 45. As can be seen in FIG. 2 and, in particular, in FIG. 3, the slit boundary surface 46 on the annular disk 28 and the boundary surface 47 on the counter ring 29 are inclined radially and outwardly. It can also be seen from FIG. 3 that the separator slot boundary surface 49 of the counter ring is somewhat more sharply inclined than is the separator slit boundary surface 46 on the annular disk 28, so that the separator slit 45 widens from the grinding chamber 20 toward the discharge chamber 33. The narrowest slit "a" is primarily chosen to restrain the grinding elements 44; however, this slit is always so narrow that the vacuum from the discharge chamber 33 does not propagate into the grinding chamber 20, which is desirable because the presence of a vacuum in the grinding chamber during the grinding or mixing process could lead to the loss of air from the stock and would impair the grinding process. After grinding or mixing, the stock passes through the narrow separator slit 45 from the grinding chamber 20 into the discharge chamber 33, so that it is subjected to high shearing forces as it passes between the relatively moving separator slit boundary surfaces 46 and 47.

Simultaneously, the stock is subjected to a subpressure or vacuum which becomes more intense toward the upper end of the separator slit 45 facing the discharge chamber 33. The stock is sprayed from the annular separator slit in the form of a layer of particles which are then still further de-aerated under the vacuum in the discharge chamber. Accordingly, the stock, which is usually paint, undergoes an exceedingly favorable de-aeration.

In a favorable mode of the invention, the ratio a/d may be from $\frac{1}{3}$ to $\frac{1}{2}$, and the diameter "d" of the grinding elements 44 may range from 0.5 mm to 2 mm. The width of the separator slit 45 increases from the narrowest point (facing the grinding chamber 20) having the width 'a' to the widest point facing the discharge chamber 33 by an amount which may range from 10*a* to 20*a*. The overall length of the slit 45 from its narrowest point to its widest point may be from 20 mm to 70 mm.

The outstanding de-aeration effect achieved by the method and apparatus of the invention is basically attributable to the fact that the air bubbles present in the ground stock burst during their exit through the separator slit 45. The amount of air in the grinding stock is very large because paints and pigments necessarily acquire much air during their preparation. Still more air is drawn into and dispersed in the grinding stock during the customary pre-mixing in so-called dissolvers. Furthermore, in an agitating mill, not only is the paint or pigment finely dispersed in its binder or solvent, but the air present is also finely dispersed.

It is to be understood that the foregoing text and drawing relate to an embodiment of the invention given by way of example but not limitation. Various other embodiments and variants are possible within the spirit and scope of the invention.

What is claimed is:

1. A method for de-aerating viscous stock, especially pasty paint, comprising the steps of:

grinding said stock in a grinding chamber where said stock is not subject to vacuum pressure;

providing an exit slot for said stock from said grinding chamber into a discharge chamber, providing vacuum pressure in said discharge chamber, and configuring said exit slot such that it prevents the vacuum pressure from entering said grinding chamber; said slot forming said stock into a layer as it exits said grinding chamber; it said slot being defined by a pair of surfaces and progressively increasing in traverse width moving from said grinding chamber to said discharge chamber; about an axis moving at least one of said surfaces during grinding and said surfaces are both inclined radially outwardly of said axis of said motion of said slot defining surfaces.

2. The method of claim 1, wherein said stock expands as it moves through said slot into said discharge chamber to thereby burst air bubbles in said stock.

3. The method of claim 1 or 2, wherein the radially outermost one of said surfaces is inclined further off said axis than is the companion surface.

4. The method of claim 1 or 2, wherein the outermost one of said surfaces is stationary and the companion surface moves with the grinding means in said grinding chamber.

5. A closed agitating mill, comprising a cylindrical container for grinding stock, said cylindrical container surrounding a grinding chamber; means for supplying stock to said grinding chamber; a rotatably drivable agitator disposed in said grinding chamber; a separator device disposed in said container between said grinding chamber and a discharge chamber, said separator device including an exit slot through which said stock is forced from said grinding chamber, means to provide vacuum in said discharge chamber, and said slot being so configured that it prevents the vacuum pressure from entering said grinding chamber; said slot forming said stock into a layer as it exits said grinding chamber; said slot being relatively elongated between said chambers and progressively increasing in traverse width moving from said grinding chamber to said discharge chamber; said slot being defined by a pair of surfaces at least one of which moves with respect to the other about an axis; and said surfaces are both inclined radially outwardly of said axis of said relative motion of said slot defining surfaces.

6. An agitating mill according to claim 5, wherein said separator device includes a central disk attached to said agitator, the periphery of said central disk and a stationary part of said cylindrical container cooperating to define said elongated slot.

7. An agitating mill according to claim 6, wherein said stationary part defines a circular hole substantially containing said central disk, the inner periphery of said stationary part and the outer periphery of said central disk together defining an annular channel serving as said elongated slot.

8. An agitating mill according to claim 5, wherein the width of said elongated slot widens progressively from its narrowest point at said grinding chamber to its widest point at said discharge chamber, an amount of from 10 to 20 times.

9. An agitating mill according to claim 5 or claim 8, wherein the length of said elongated slot is 20 to 70 mm.

10. An agitating mill according to claim 9, wherein the width of said elongated slot at its narrowest point is from 0.165 mm to 1.0 mm.

11. An agitating mill according to one of claims 5, 6, 7, or 8, wherein the radially outermost one of said surfaces is inclined further off said axis than is the companion surface.

12. An agitating mill according to claim 10 wherein the radially outermost one of said surfaces is inclined further off said axis than is the companion surface.

* * * * *